United States Patent [19]

Vehling

[11] Patent Number: 4,817,879

[45] **Date of Patent: * Apr. 4, 1989**

[54] SPOOLING MACHINE

[75] Inventor: Ernst Vehling, Bordesholm, Fed. Rep. of Germany

[73] Assignee: Neumuenstersche Maschinen-und Apparatebau GmbH (Neumag), Neumuenster, Fed. Rep. of Germany

[ * ] Notice: The portion of the term of this patent subsequent to Feb. 9, 2005 has been disclaimed.

[21] Appl. No.: 95,154

[22] PCT Filed: Dec. 2, 1986

[86] PCT No.: PCT/EP86/00697

§ 371 Date: Sep. 4, 1987

§ 102(e) Date: Sep. 4, 1987

[87] PCT Pub. No.: WO87/03569

PCT Pub. Date: Jun. 18, 1987

[30] Foreign Application Priority Data

Dec. 10, 1985 [DE] Fed. Rep. of Germany ..... 3543565

[51] Int. Cl.[4] ..... B65H 54/20; B65H 54/32

[52] U.S. Cl. ..... 242/35.5 R; 242/43 A; 242/43.1; 242/158 B

[58] Field of Search ..... 242/35.5 R, 43 R, 43 A, 242/43.1, 158 B

[56] References Cited

U.S. PATENT DOCUMENTS

| | | | |
|---|---|---|---|
| 2,238,128 | 4/1941 | Nydegger | 242/43 A |
| 4,723,722 | 2/1988 | Vehling | 242/35.5 R |

FOREIGN PATENT DOCUMENTS

| | | |
|---|---|---|
| 809515 | 7/1951 | Fed. Rep. of Germany . |
| 1535091 | 2/1970 | Fed. Rep. of Germany . |
| 2622243 | 12/1977 | Fed. Rep. of Germany . |
| 3444648 | 6/1985 | Fed. Rep. of Germany . |
| 3505188 | 8/1986 | Fed. Rep. of Germany . |
| 836117 | 10/1938 | France . |

*Primary Examiner*—Stanley N. Gilreath

*Attorney, Agent, or Firm*—Michael J. Striker

[57] ABSTRACT

A spooling machine for the simultaneous spooling of at least two threads on an equal quantity of winding places, which are arranged so as to be adjacent to one another in a row, is equipped with a belt-type traversing device. The traversing is effected by means of carriers (28*a*–28*d*) which are moved in opposite directions and which fit on a revolving toothed belt (20) so as to be uniformly spaced (y), and alternately grasp the threads (8*a*–8*d*). The reversing points of the traversing areas of the individual winding places are marked by means of deflectors (47*a*–47*d*; 51*a*–51*d*). The effective spacing (z) between two corresponding deflectors (47*a*–51*a*; 47*b*–51*b*; *47c*–51*c*; 47*d*–51*d*), which effective spacing (z) determines the traversing stroke is smaller than the center distance (x) between two traversing areas. This is exactly half as large as the spacing (y) between two adjacent carriers (28*a*–28*d*).

8 Claims, 3 Drawing Sheets

SPOOLING MACHINE

TECHNICAL FIELD

The invention is directed to a spooling machine for simultaneously spooling at least two threads on the same quantity of winding places, which are arranged adjacent to one another in a row, by means of a so-called belt-type traversing device which comprises the following characteristic features:

(a) two intermediate portions of the belt, which are moved in a straight line in opposite directions and are arranged adjacent to one another, are equipped with uniformly spaced carriers;

(b) at least two pairs of deflectors, which mark the reversing points of the individual traversing areas and are suitable for passing a thread from one carrier to a carrier approaching in the opposite direction, are arranged adjacent to the intermediate portions of the belt in accordance with the quantity of winding places.

Prior Art

In order to spool at extremely high thread speeds—e.g. 6,000 m/min.—spooling machines are known in which the thread is guided in reciprocating motion by means of carriers which are fastened on two intermediate portions of the band or belt which are moved in opposite directions and are arranged adjacent to one another. The alternating movement of the thread is not effected by means of a single reciprocated thread guide, as in conventional traversing devices, but, rather, in that the carriers, which are moved in opposite directions, alternately grasp and guide the threads. Since the carriers are neither accelerated nor decelerated at the reversing points of the thread, the influence of the inert mass of the thread guide members is completely eliminated during the thread reversal.

The manner of operation of this known belt-type traversing device is known, e.g., from DE-OS No. 15 35 091. If one follows the movement of a carrier fastened on one intermediate portion of the belt, which carrier is met by a carrier of the other intermediate portion of the belt at a determined point, it can easily be seen that the distance between the meeting point with the next carrier of the other intermediate portion of the belt and the first meeting point is half as great as the distance between two adjacent carriers of an intermediate belt portion. This is a result of the intermediate portions of the belt moving in opposite directions at the same speed. Since the thread is fed from a carrier of one intermediate portion of the belt to a carrier of the other intermediate portion of the belt at a meeting point, the traversing stroke of the thread is equal to the distance between two meeting points. The feed is effected by means of a suitable shaping of the carriers and is facilitated by means of stationary deflectors which are arranged at the meeting points.

It also follows from the indicated text and the U.S. Pat. Nos. 22 38 128 and DE-OS 26 22 243 that the intermediate portions of the belt can extend over the traversing areas of a plurality of winding places which are arranged adjacent to one another. However, a more detailed description of the construction and manner of operation of belt-type traversing devices for the simultaneous spooling of a plurality of threads does not follow from the previously cited texts.

A traversing device is indicated schematically in DE-OS No. 35 05 188 in which the distance over which the intermediate portions of the belt run adjacent to one another amounts to a multiple of the distance between two carriers. Therefore, a plurality of meeting points are located along this distance so as to be uniformly spaced. This is made use of in order that a single pair of intermediate belt portions serves a plurality—four in the present example—of winding places. According to the teaching of this text, the distance between two carriers is equal to twice the traversing stroke of the thread; obviously, it is assumed as self-evident that the traversing stroke is equal to the distance between two meeting points. This results in a problem: For obvious reasons, it is not possible to wind adjacent spools in such a way that the end faces which face one another lie very close to one another. But if a spacing between two spools is urgently necessary, this spacing must be equal to the spacing between two meeting points or must be a multiple of the latter because of the unalterable position of the meeting points. Accordingly, the text teaches that the center distance between the winding places equals twice the traversing stroke. That is, in other words, the distance between two spools is equal to the length of a spool.

The problem with which the DE-OS No. 34 44 648 is concerned is that of arranging a plurality of spools to be wound in a spooling machine with belt-type traversing device so as to be closely adjacent to one another as is conventional in traversing devices with a reversing thread roller drive.

In order to solve this problem a compensation of length must be carried out at the revolving intermediate portions of the belt. For this purpose, the intermediate belt portions between two adjacent traversing devices are deflected from the traversing plane by means of deflecting rolls, wherein the deflection distance is a whole-number multiple of the length of the traversing stroke. The arrangement of the deflecting rolls is more costly in terms of construction the more winding places are arranged on a winding mandrel. In practice, it may already be difficult to accommodate more than two winding places on a winding mandrel. Readjusting a machine which is equipped for a determined quantity of winding places to a different quantity of winding places may only be possible—if at all—with considerable conversion work.

DISCLOSURE OF THE INVENTION

The present invention has the object of providing a spooling machine pertaining to the technical field indicated in the beginning which makes it possible to produce a plurality of closely adjacent windings with the lowest expenditure and which can be easily readjusted to a different quantity of winding places.

This object is met, according to the invention, in that the center distances of the traversing areas are half as great as the distances between the carriers of an intermediate portion of the belt and in that the effective spacing of the two deflectors of a traversing area is smaller than the center distances of the traversing areas. The "traversing area" of each spool is the region where a thread performs its reciprocating movement. The length of the traversing area corresponds to the traversing stroke of the thread.

The "effective spacing" of the two deflectors is the spacing of the points at which the thread is actually detached from the arriving carrier by means of the deflector.

The effective spacing is therefore equal to the traversing stroke. According to the invention, the effective spacing is deliberately made smaller than the spacing between two meeting points; the difference is used for maintaining the indispensable spacing between the end faces of two adjacent spools. The advantage over the device according to DE-OS No. 35 05 188 consists particularly in that twice as many spools can be accommodated on a winding mandrel of the same length. The advantage over the device according to DE-OS No. 34 44 648 consists in the simplicity and ease of readjusting to a different quantity of winding places.

Another characteristic feature of the invention consists in that the deflectors are displaceable in the longitudinal direction of the axis of a winding mandrel and are coupled with a feeler member contacting the winding surface by means of a gear unit for the purpose of a spacing between the two deflectors of a traversing area, which spacing decreases as the winding diameter increases. Accordingly, it is possible to reduce the effective spacing of the deflectors as the winding diameter increases and, in this way, to produce windings with conical or curved end faces.

SHORT DESCRIPTION OF THE DRAWING

The drawing serves to explain the invention with the aid of an embodiment example which is shown in a simplified manner.

Figure 1:
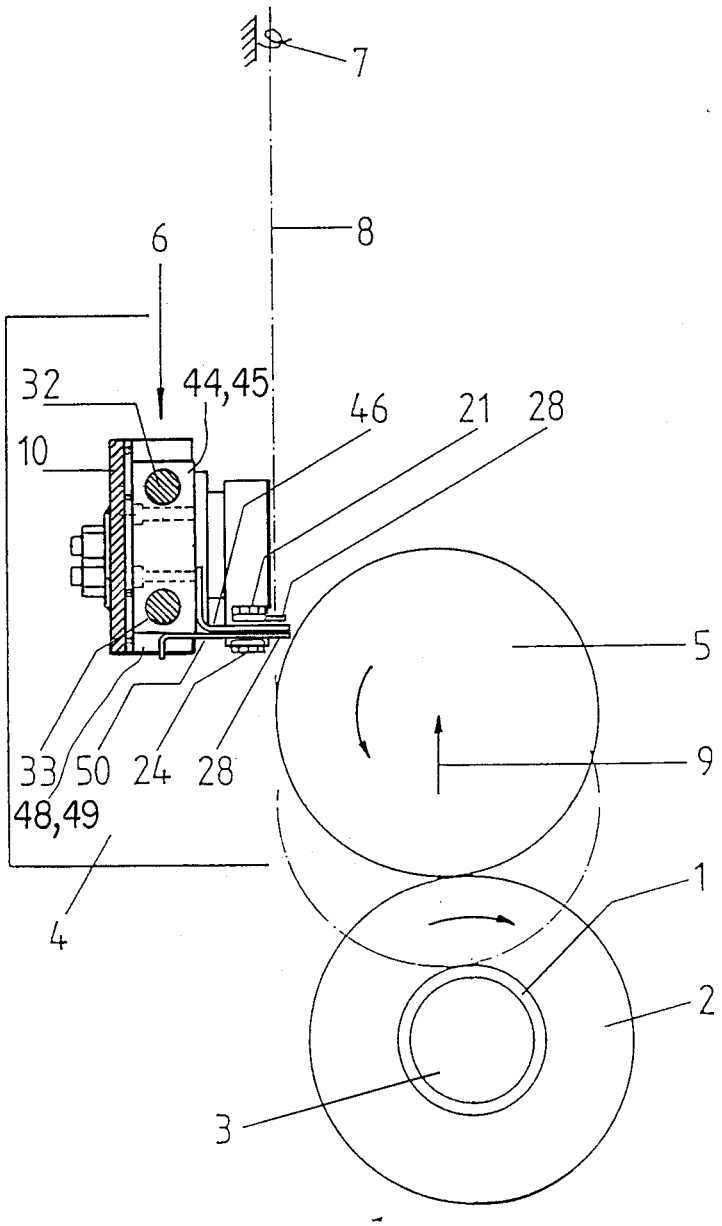
FIG. 1 is a schematic presentation of the spooling machine, partially in section, from the side.

FIG. 1 shows a sleeve 1 with windings 2 on a winding mandrel 3. As will be seen in the following, the spooling machine has a total of four winding places located adjacent to one another in a row, i.e. a total of four sleeves with four windings are arranged on the mandrel 3. The winding mandrel 3 is connected with a machine frame, not shown, in such a way that its position does not change relative to the machine frame during the construction of the winding 2. For example, it can be arranged on a revolving head.

A driving roller 5, which is driven by a motor, not shown, is supported in a housing 4, which is only indicated schematically and is reciprocated in its vertical guide relative to the machine frame. A traversing device 6 is accommodated in the housing 4 so as to be closely adjacent to the driving roller 5.

By means of thread guides 7, which are immovably connected with the machine frame and are centrally arranged along the assigned winding places corresponding to the quantity of winding places, threads 8 are fed to the traversing device 6 at a high speed, pass through a short open distance, contact a bend approximately greater than 90° at the surface of the driving roller 5, and, from there, reach the windings 2. Corresponding to the increasing winding diameter, the driving roller 5 moves upward together with the traversing device, as symbolized by arrow 9.

The traversing device 6 is arranged in the housing 4 at a cross member 10. A motor 13 with a toothed driving pulley 14 is arranged on a plate 11 so as to be adjustable in the longitudinal direction of the cross member 10 by means of an adjusting screw 12, the plate 11 being welded with the cross member 10. A deflecting pulley 15, which is also toothed, is supported on a carriage 16 at the other end of the cross member 10, the carriage 16 being guided on guide rods 17 so as to slide in the direction of the cross member 10. A tension spring 18, which is supported on a stirrup 19, presses the carriage 16 in the direction of the end of the cross member 10. A continuous toothed belt 20 is guided along the driving pulley 14 and the deflecting pulley 15. The upper intermediate portion 21 of the toothed belt 20 is deflected in such a way by means of two additional toothed disks 22, 23 supported in the vicinity of the driving pulley or the deflecting pulley 15 that it runs parallel to the lower intermediate portion 24 of the belt so as to be at the shortest possible distance from it. In the rotating direction of the driving pulley 14, indicated by means of arrow 25, the upper intermediate belt portion 21 runs in the direction of arrow 26, while the lower intermediate belt portion 24 runs in the opposite direction according to arrow 27.

Carriers 28 are fastened so as to be uniformly spaced on the edge of the toothed belt 20 remote of the cross member 10.

A bearing housing 29, in which is supported a toothed wheel 30 having a horizontal axis, is fastened at the cross member 10 above the upper intermediate portion 21 of the belt so as to be closely adjacent to the toothed disk 23. A guide block 31 is fastened on the other side of th cross member 10 in the vicinity of the toothed disk 22 which is adjacent to the motor 13.

An upper connecting bar 32 and a lower connecting bar 33 are guided in boreholes of the guide block 31 and the bearing housing 29 so as to slide parallel relative to one another and to the two intermediate portions 21, 24 of the toothed belt 20. In the area of the bearing housing 29, the two connecting bars 32, 33 are provided with teeth on the sides facing one another, which teeth mesh with the toothed wheel 30 at places which are offset relative to one another by 180°.

A bushing 34 is securely arranged on the lower connecting bar 33. A pressure spring 35, which is supported at an abutment 36, presses the bushing 34 and, accordingly, the lower connecting bar 33, in the direction of the motor 13. As a result of the coupling running in opposite directions, which is effected by means of the toothed wheel 30, the upper connecting bar 32 is pressed in the opposite direction—to the right in the drawing.

The upper connecting bar 32 is lengthened beyond the end of the cross member 10 on the side on which the deflecting pulley 15 is arranged, and its end is provided with a feeler roll 37. The latter contacts a guide rail 38 without play under the pressure exerted by the spring 35.

The guide rail 38 is swivelable around a pivot 39 which fits into a fork 40 which is welded on at the machine frame. In the basic position, which is shown by means of continuous lines, the guide rail 38 is arranged so as to be vertical, i.e. at a right angle to the direction of the intermediate belt portions 21, 24 and accordingly also at a right angle to the winding axis.

From this position, it is swivelable around an angle up to approximately 30° in the direction of arrow 41 in the plane in which the connecting bars 32, 33 are located. Within this angular area, it can be stopped in every position—such as in the position 38' shown by means of broken lines—by means of adjusting screws 42, 43.

Connecting pieces 44, 45, which reach down to the level of the intermediate belt portions 21, 24, are securely clamped at the upper connecting bar 32. A thin strip 46, which lies flat in the narrow intermediate space between the intermediate belt portions 21, 24 and extends practically along the entire free length between the toothed disks 22, 23, is screwed onto the connecting pieces 44, 45. The connecting pieces 44, 45 are provided with boreholes in which the lower connecting bar 33 slides freely. The strip 46 is provided with a total of four deflectors **47*a*–47*d* (particularly FIG. 5) which are uniformly spaced and which project out in front over the front edge of the toothed belt 20 slightly further than the carriers 28 themselves, the front edge being outfitted with the carriers 28. The deflectors 47 of the strip 46** are beveled in a wedge-shaped manner at the flank facing the motor—toward the left in the drawing.

Correspondingly, a strip 50, which is likewise located between the intermediate belt portions 21, 24 under the strip 46 in a close fitting manner, is connected with the lower connecting bar 33 by means of connecting pieces 48, 49 which are provided with boreholes for the sliding passage of the upper connecting bar 32. The strip 50 has four deflectors **51*a*–51*d* which are arranged so as to be spaced in the same manner as the deflectors 47*a*–47*d*,** but on the opposite side, at right in the drawing.

Figure 5:
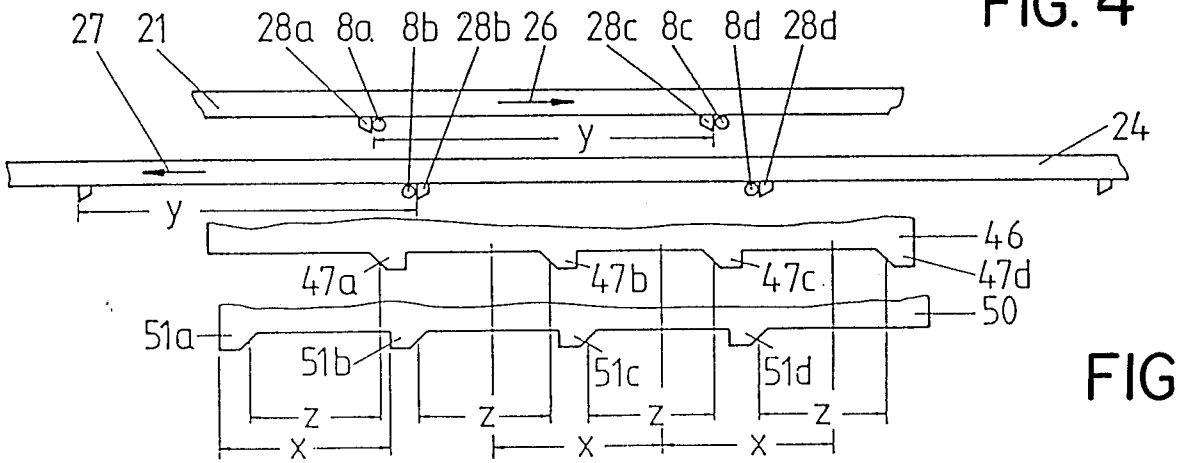
FIG. 5 shows individual portions of the traversing device from above, the individual portions being shown in transversely exploded presentation.

In the position which is shown in the drawing and can be seen particularly clearly from FIG. 5, the deflectors overlap with their broader sides in each instance: **47*a* with 51*b*, 47*b* with 51*c*, and 47*c* with 51*d*.**

The distance x between every two deflectors **47*a*–47*d* is exactly half as large as the distance y between two adjacent carriers 28*a*–28*d* the same is true for the spacing of deflectors 51*a*–51*d*.**

A total of four threads **8*a*–8*d* are fed to the spooling machine shown in the drawing (FIG. 5). The threads 8*a* and 8*c* are moved to the right in the drawing by the carriers 28*a* or 28*c* of the upper intermediate belt portion 21; the threads 8*b* and 8*d* are moved to the left by the carriers 28*b* and 28*d* of the lower intermediate belt portion 24. In the indicated position, the threads 8*a* and 8*c* are already in contact with the flanks of the deflectors 47*a*, 47*c*, which flanks slope in a wedge-shaped manner; and the threads 8*b* and 8*d* are likewise in contact with the flanks of the deflectors 51*b*, 51*d*,** which flanks are beveled in the opposite direction.

The threads **8*a*and 8*c* are located directly in front of the right-hand reversing point of their traversing area; the threads 8*b* and 8*d* are located in front of the left-hand reversing point. In the next moment, all the threads will be removed from contact with the respective carriers by means of the deflectors and will reverse their movement direction—effected by means of the central arrangement of the thread guides 7 along the assigned winding places. After they have first freed themselves, they are gathered by one carrier in each instance; specifically, thread 8*a* is gathered by the carrier 28*b*, thread 8*b* is gathered by the carrier 28*a*, thread 8*c* is gathered by the carrier 28*d*, and thread 8*d* is gathered by the carrier 28*c*.**

This play is repeated corresponding to the opposite reversing points of the individual traversing areas.

The total of four traversing areas are defined by means of the deflector pairs **47*a*–51*a*, 47*b*–51*b*, 47*c*–51*c*, and 47*d*–51*d*. The exact boundary of the traversing area is at that place at which the wedge-shaped slopes of the deflector penetrate the plane in which the outermost tips of the carriers 28 rotate. The effective spacing z, i.e., the spacing defined by means of the boundaries of the traversing area, is smaller than the center distance x between two adjacent traversing areas, which—in agreement with the distance between adjacent deflectors 47*a*–47*d* and 51*a*–51*d*—is exactly half as large as the spacing y between two adjacent carriers 28*a*–28*d*.**

If the guide rail 38 is vertically upright, the positions of the deflectors **47*a*–47*d* and 51*a*–51*d*** remain unchanged during the winding. The windings receive level end faces. The length of a winding—i.e. the spacing between its two end faces—agrees with the effective spacing z. The length of the sleeve is x. The spacing between the end faces of two adjacent windings, which end faces face one another, i.e. the difference between x and z, can be small in comparison with the length of the winding. The sleeve need only project slightly from the end faces of the finished windings in order to prevent the windings from sliding off the sleeve ends and so that there is enough room, if necessary, for a knotting lap.

Figure 2:
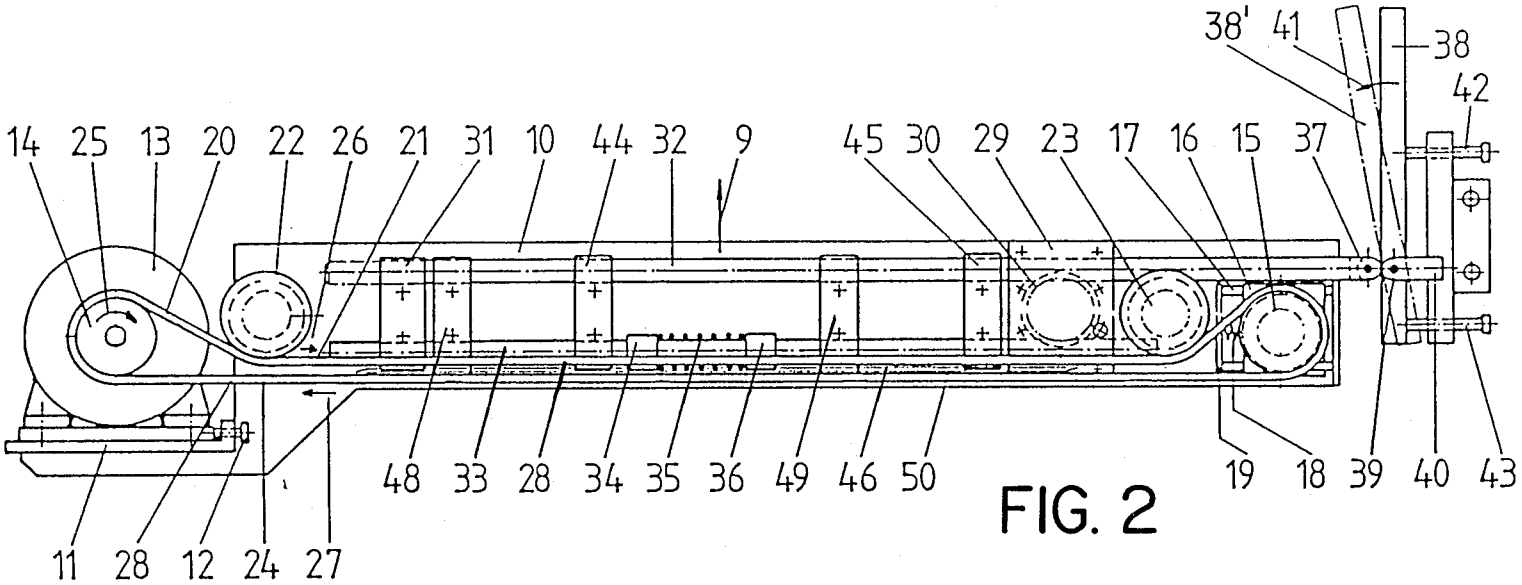
FIG. 2 shows a front view of the traversing device.
Figure 3:
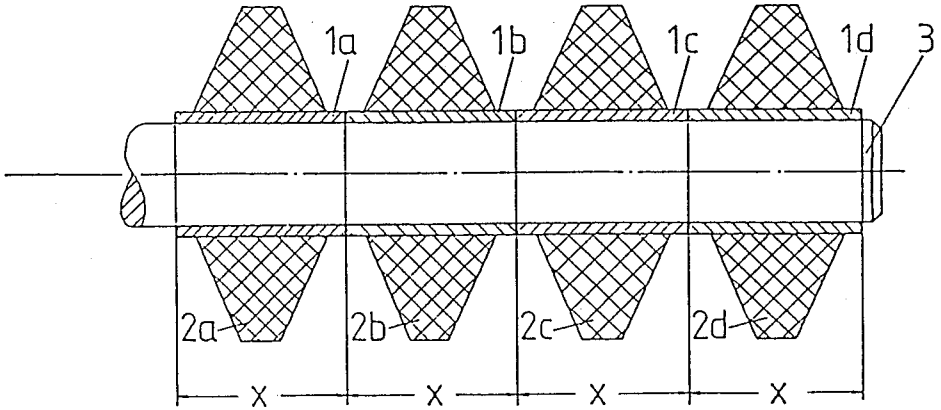
FIG. 3 shows the arrangement of the windings in section.
Figure 4:
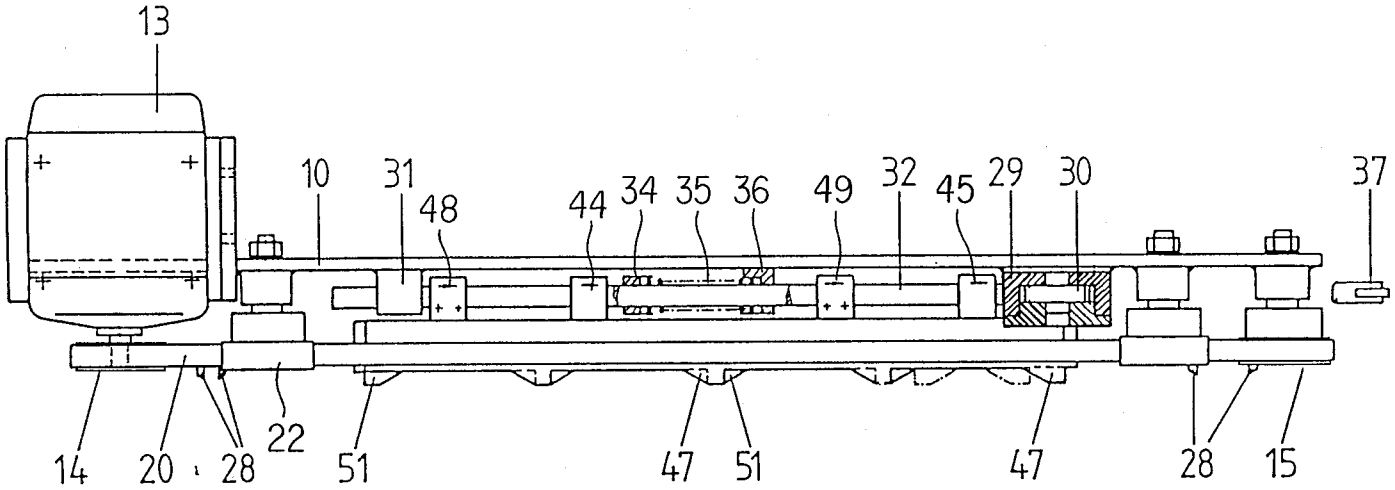
FIG. 4 shows the traversing device from above.

However, if the guide rail 38 occupies the inclined position, which can be seen in FIG. 2, the feeler roll 37, which moves forward on the guide rail 38, and, along with it, the connecting bar 32 receive a horizontal movement component—in the left-hand direction in the drawing—corresponding to the inclination of the guide rail 38. The connecting bar 33 compulsorily moves to the right. The strips 46, 50, with the deflectors 47, 51, move to the same extent as the connecting bars 32, 33. The deflectors **47*a* and 51*a*. which determine the reversing points for the construction of the winding 2*a*, thus move toward one another as the winding diameter increases, as do the other respective pairs of deflectors. The traversing stroke decreases, and the winding becomes conical, wherein the cone exactly corresponds to the angular adjustment of the guide rail 38.**

If the spooling machine is to be readjusted from four winding places to eight correspondingly narrower winding places, the toothed belt 20 is exchanged for another toothed belt which comprises twice the quantity of carriers along the same length. Moreover, the strips 46, 50 are to be exchanged for strips with deflectors which are arranged so as to be correspondingly closer. The gear unit for the automatic displacement of the deflectors remains unchanged; possibly, the angle of taper can be changed by means of a simple adjustment of the guide rail 38.

Embodiment Forms of the Invention

The preferred embodiment form of the invention is that shown in the drawing. Among other things, it is characterized in that the two intermediate belt portions belong to a single revolving continuous belt. However, the invention is also usable in spooling machines whose belt-type traversing devices comprise two revolving continuous belts, wherein—as is known from the texts given as prior art—an intermediate portion of one belt is adjacent to an intermediate portion of the other belt which is moved in the opposite direction.

For the sake of simplicity and clarity, the word "belt" is used in the foregoing description so as to be representative of other traction mechanisms, as well, such as bands, chains, and ropes, which can, in principle, be used in such traversing devices instead of belts; however, belts, specifically toothed belts, are preferred.

Commercial Applicability

The primary field of application of the spooling machine, according to the invention, is the production and processing of threads of synthetic material.

I claim:

1. A spooling machine having at least two winding places that are arranged adjacent to each other in a row and having a traversing device, comprising:

a plurality of intermediate belt portions arranged adjacent to each other, each of said intermediate belt portions having a plurality of carriers uniformly spaced apart from each other by a predetermined uniform distance (y) and including a first carrier and a second carrier, means for moving said intermediate belt portions linearly in opposite directions so as to move said carriers in association therewith and thereby move said first carrier and said second carrier in opposite directions with respect to each other; and means for feeding a thread from said first carrier to said second carrier and including a plurality of pairs of deflectors having a traversing area at which a respective one of said deflectors actually detaches said thread from an arriving one of said carriers, said adjacent deflectors being arranged so as to mark a place of reversal of said transversing area individually and thereby correspond to a predetermined number of winding places, adjacent two of said deflectors being spaced apart from each other by a predetermined spacing (x) that is half as large as said predetermined uniform distance between said carriers, said adjacent deflectors being formed to have an effective spacing (z) that is smaller than said predetermined distance (x), said effective spacing (z) which constitutes a distance between said transversing area of each of said adjacent deflectors and which is smaller than said predetermined distance (x).

2. The spooling machine as defined in claim 1; further comprising:

a winding mandrel (3) having a longitudinal axis, said deflectors (47*a–d;* 51*a–d*) displacing along said longtudinal axis of said winding mandrel (3);

a plurality of windings (2) on said winding mandrel (3), said windings (2) each having a winding surface and winding diameter;

a drive member (5);

transmission means (37, 38) for coupling said deflectors (47*a–d,* 51*a–d*) with said drive member (5), said drive member (5) being formed to contact said winding surface so as to move said adjacent two deflectors (47*a–d,* 51*a–d*) relative to each other and thereby define said predetermined spacing (x) between said adjacent two deflectors (47*a*–51*a;* 47*b*–51*b;* 47*c*–51*c;* 47*d*–51*d*) so that said predetermined spacing (x) becomes smaller in response to an increase to an increase in said winding diameter.

3. The spooling machine as defined in claim 2, wherein said drive member is formed as a driving roll.

4. A spooling machine, comprising:

a plurality of intermediate belt portions adjacent to each other, said intermediate belt portions having a plurality of carriers spaced apart from each other by a predetermined distance (y), means for moving said intermediate belt portions whereby said carriers move in opposite directions with respect to each other; and means for feeding a thread from one of said carriers to another carrier moving in opposite direction and including a plurality of pairs of deflectors arranged adjacent to said intermediate belt portions, adjacent two of said deflectors being spaced apart from each other by a predetermined spacing (x) that is one-half as large as said predetermined distance (y), said adjacent deflectors having a traversing area at which a respective one of said deflectors actually detaches the thread from an arriving one of said carriers, said adjacent deflectors being formed to have an effective spacing (z) which constitutes a distance between said transversing area of each of said adjacent deflectors and which is smaller than said predetermined distance (x).

5. The spooling machine as defined in claim 4, wherein said plurality of carriers (28) are uniformly spaced apart from each other.

6. The spooling machine as defined in claim 4; further comprising:

means for adjusting said predetermined spacing (x) and including a feeler member, means for adjustably moving said feeler member and means connected between said feeler member and said deflectors so as to move said deflectors relative to each other and thereby change said predetermined spacing (x).

7. The spooling as defined in claim 6 wherein said:

means for adjustably moving said feeler member (37) including an adjustably movable guide rail (38) arranged so as to move said feeler member (37) in association therewith.

8. The spooling machine as defined in claim 7 including means for angular adjusting said guide rail (38), said deflectors (47*a–d;* 51*a–d*) being formed to move in response to said angular adjusting so that the winding becomes conical in correspondance to said angular adjusting.

* * * * *